US005224424A

United States Patent [19]

Layland

[11] Patent Number: 5,224,424

[45] Date of Patent: Jul. 6, 1993

[54] PRINTING PRESS WASH-UP SYSTEM

[76] Inventor: Jon L. Layland, 414 Second Ave. East, P.O. Box 205, Holmen, Wis. 54636

[21] Appl. No.: 815,381

[22] Filed: Dec. 31, 1991

[51] Int. Cl.[5] ..... B41F 35/00

[52] U.S. Cl. ..... 101/425; 101/423; 101/157; 101/169

[58] Field of Search ..... 101/425, 423, 157, 169, 101/366

[56] References Cited

U.S. PATENT DOCUMENTS

| | | | |
|---|---|---|---|
| 1,772,470 | 8/1930 | Snyder | 101/425 |
| 2,302,490 | 11/1942 | Curtis | 101/425 |
| 2,612,105 | 9/1952 | Skinner | 101/425 |
| 2,704,029 | 3/1955 | George | 101/425 |
| 3,601,051 | 8/1971 | Gegenheimer et al. | 101/425 |
| 3,630,148 | 12/1971 | Schinke et al. | 101/425 |
| 3,738,265 | 6/1973 | Saueressig | 101/157 |
| 3,800,702 | 4/1974 | Roberts | 101/425 |
| 3,897,726 | 8/1975 | Junghans | 101/425 |
| 4,009,657 | 3/1977 | Bonanno et al. | 101/157 |
| 4,026,210 | 5/1977 | Merzagora | 101/169 |
| 4,111,624 | 9/1978 | Hanson | 101/235 |
| 4,254,709 | 3/1981 | Arnolds | 101/425 |
| 4,270,450 | 6/1981 | Difflipp et al. | 101/425 |
| 4,344,361 | 8/1982 | MacPhee et al. | 101/425 |
| 4,534,291 | 8/1985 | Sabota et al. | 101/425 |
| 4,632,030 | 12/1986 | Laverick | 101/425 |
| 4,686,902 | 8/1987 | Allain et al. | 101/425 |
| 4,699,668 | 10/1987 | Burns, Jr. et al. | 101/425 |
| 4,875,412 | 10/1989 | Wright et al. | 101/425 |
| 5,003,876 | 4/1991 | Harrison et al. | 101/425 |
| 5,003,877 | 4/1991 | Yano et al. | 101/425 |
| 5,086,701 | 2/1992 | Gasparrini et al. | 101/423 |
| 5,103,730 | 4/1992 | Sarda | 101/425 |

FOREIGN PATENT DOCUMENTS

| | | | |
|---|---|---|---|
| 0381715 | 10/1964 | Switzerland | 101/425 |
| 1434025 | 4/1976 | United Kingdom | 101/425 |

*Primary Examiner*—Edgar S. Burr
*Assistant Examiner*—Lynn D. Hendrickson
*Attorney, Agent, or Firm*—Merchant, Gould, Smith, Edell, Welter & Schmidt

[57] ABSTRACT

A printing press wash-up system is disclosed comprising a fluid receptacle arrangement, a mounting assembly, a wiper assembly, and a pivoting arrangement. The fluid receptacle arrangement is constructed and arranged to operably receive fluid from a printing press roller when it is mounted to the printing press by means of the mounting assembly. The wiper assembly selectively removes fluid from the printing press rollers in operable association with the fluid receptacle arrangement to direct fluid from the roller to the fluid receptacle arrangement. The pivoting arrangement selectively pivots the fluid receptacle arrangement between a first and second extreme position, the first extreme position occurring when the fluid receptacle arrangement is operably positioned to selectively receive fluid from the printing press roller and the second extreme position occurring when the fluid receptacle arrangement is positioned such that it cannot selectively receive fluid from the printing press roller. The pivoting arrangement allows the fluid receptacle arrangement to be readily cleaned out after a cleansing operation has been completed. In addition, the pivoting arrangement allows a person to readily gain access to the printing press rollers without having to remove the fluid receptacle arrangement from the printing press.

10 Claims, 5 Drawing Sheets

PRINTING PRESS WASH-UP SYSTEM

FIELD OF THE INVENTION

This invention relates to a printing press wash-up device for removing fluid from printing press rollers.

BACKGROUND OF THE INVENTION

The rollers of a printing press are usually cleansed with solvents after each printing. The cleansing process is necessary to prevent ink, dust and other foreign materials, which could affect the quality of any subsequent printing operations, from becoming bound to the printing rollers.

A typical conventional ink removing device, as shown in U.S. Pat. No. 1,772,470 to W. J. Schneider, can be attached to a printing press roller after the printing operation is completed. A blade on the cleaning apparatus will contact the roller and provide for removal of ink and cleansing solvents prior to the subsequent printing process. This ink cleaning apparatus is typically positioned in a permanent contact orientation with the printing press roller. As a consequence, it is necessary to remove the ink cleaning apparatus after each cleansing operation.

More recent embodiments of ink removing apparatus include devices which can be permanently mounted to the printing press because their cleaning blades are adapted to pivot between a contact position with the printing press roller during a cleansing operation and a non-contact orientation during the printing operation of the printing press. Examples of such devices are shown in U.S. Pat. Nos. 3,601,051 and 4,254,709, the disclosures of which are incorporated herein by reference. These permanently-mounted ink cleansing apparatus, however, have ink pans which remain in close proximity to the printing press rollers. As a consequence, these ink pans are either completely detached from the printing press ink cleansing apparatus so that they may be washed out, or left in close proximity to the printing press rollers during the cleaning of the pan.

SUMMARY OF THE INVENTION

The present invention is directed towards a cleaning assembly for removing fluid from printing press rollers. The cleaning assembly includes a fluid receptacle arrangement that is constructed and arranged so that it will operably receive fluid from a printing press roller, i.e. receive fluid during a roller cleaning operation. The preferred fluid receptacle arrangement comprises a base wall and four exterior walls extending from the base wall to form a trough-shaped receptacle.

The cleaning assembly further includes a mounting assembly which secures the fluid receptacle arrangement in operable relation to a printing press roller so that it may receive fluid therefrom. The preferred mounting assembly includes first and second frame plates and first and second U-bolts for operably engaging the end portions of a mounting bracket. The first U-bolt operably attaches to the first frame plate of the fluid receptacle arrangement and the second U-bolt operably attaches to the second frame plate of the fluid receptacle arrangement, so that the fluid receptacle arrangement is oriented to operably receive fluid from a roller in the printing press.

The cleaning assembly further includes a wiper assembly which is in operable association with the fluid receptacle arrangement so that the wiper assembly may selectively direct fluid from the roller to the fluid receptacle arrangement when it is in contact with the roller of a printing press. The preferred wiper assembly generally includes a wiper holder and flexible wiper blade which may be constructed of rubber or soft plastic. When the wiper blade is in contact with a printing press roller, it will skim fluids from the roller and direct them towards the fluid receptacle arrangement by means of the wiper holder.

The preferred cleaning assembly also includes a pivoting arrangement which selectively pivots the fluid receptacle arrangement between a first and second extreme position. The preferred pivot arrangement is operably positioned adjacent to an end portion of the fluid receptacle such that a first axis extending therethrough is generally orthogonal to (but not necessarily intersecting) a second axis extending through the printing press roller. The first extreme position occurs when the fluid receptacle arrangement is operably positioned to selectively receive fluid from the roller and the printing press. The second extreme position occurs when the fluid receptacle arrangement is positioned such that it cannot selectively receive fluid from the roller or the printing press. Preferably, the second extreme position is defined when the fluid receptacle arrangement is rotated about its pivot axis (first axis) between approximately 45° to 135° with respect to the first extreme position.

The cleaning assembly may optionally include a drain arrangement, for example comprising an aperture in the base wall of a fluid receptacle arrangement, which allows any fluid collected in the fluid receptacle arrangement to flow by gravity out of the fluid receptacle arrangement through the aperture. A vacuum apparatus may be also included in the cleaning assembly so that fluids collected in the fluid receptacle arrangement can be operably drawn from the fluid receptacle arrangement during a cleaning operation.

The cleaning assembly may also include a locking arrangement for locking the wiper blade in first or second extreme orientations. The first extreme orientation occurs when the wiper blade is operably contacting the roller during a cleaning phase. The second extreme orientation occurs when the wiper blade is selectively oriented such that the wiper blade does not contact the roller during the printing phase.

BRIEF DESCRIPTION OF THE DRAWINGS

in FIG. 8 portions being broken away to show internal detail.

in FIG. 9 portions being broken away to show internal detail.

DETAILED DESCRIPTION OF THE INVENTION

Figure 2:
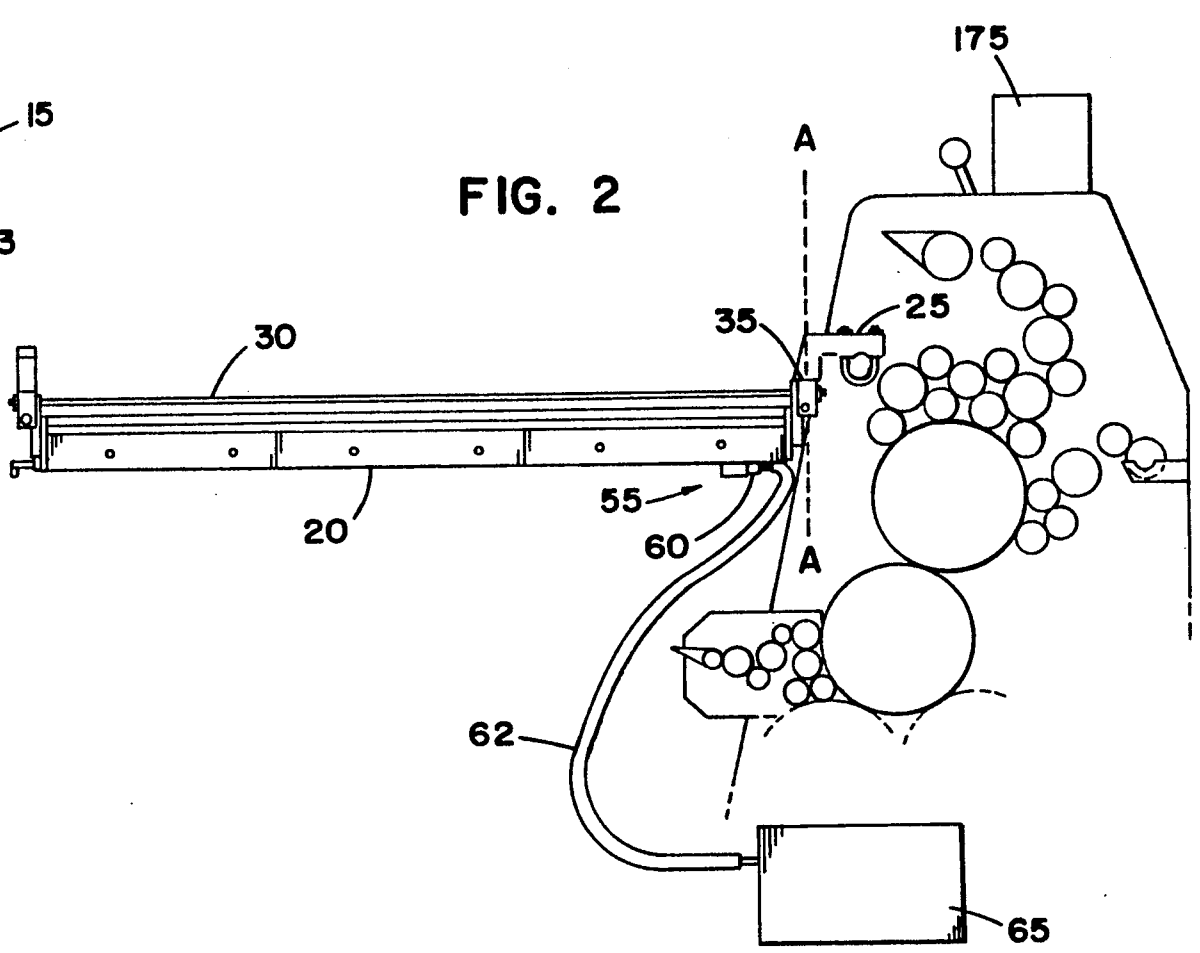
FIG. 2 is a fragmentary side elevational schematic view of the arrangement shown in FIG. 1 with a portion of the cleanup assembly pivoted about axis A—A with respect to the printing press, relative to FIG. 1.
Figure 1:
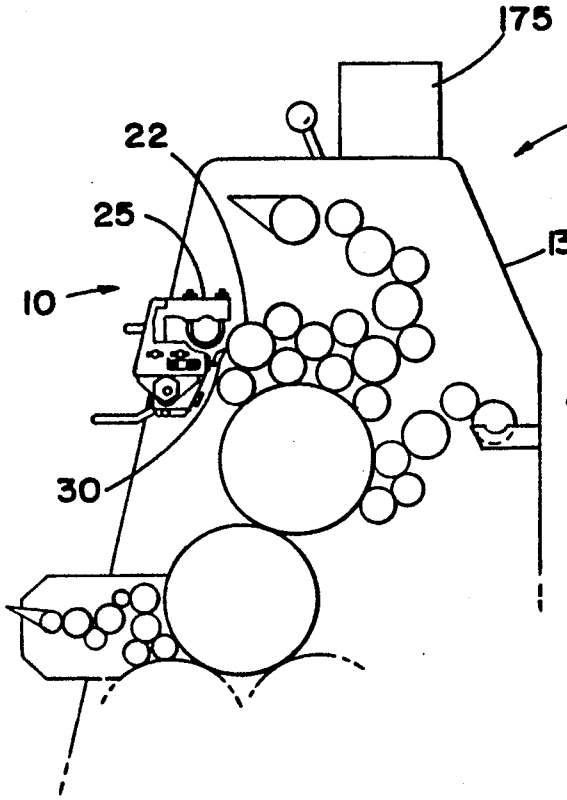
FIG. 1 is a fragmentary side schematic view, in elevational, of a cleanup assembly according to the present invention mounted to a printing tower.

The reference numeral 10, FIG. 1, generally designates a cleaning assembly 10 according to the present invention. The cleaning assembly 10 is shown in side elevation, with the drawing being a schematic view. FIGS. 1 and 2 are intended to reflect the principles of the present invention, regardless of the specific embodiment in which it is applied. As shown in FIG. 1, cleaning assembly 10 is mounted to a printing tower 13 in a printing press 15.

Figure 4:
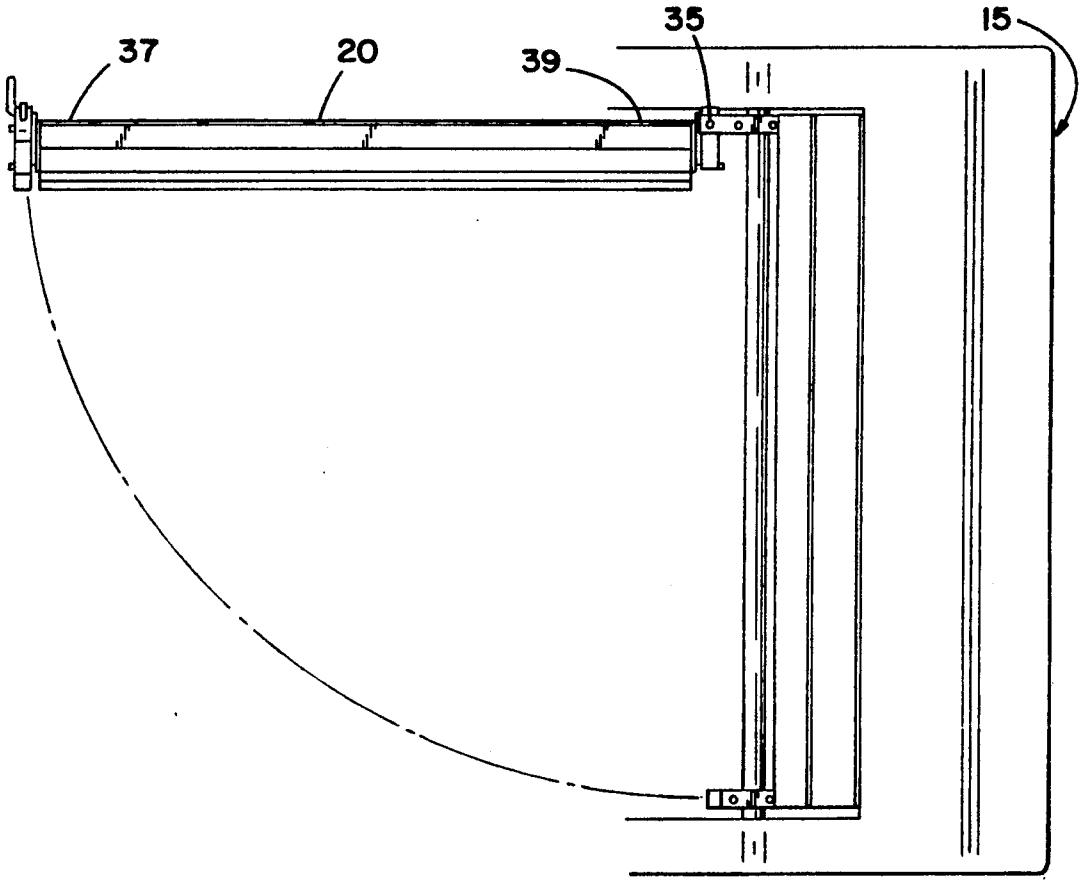
FIG. 4 is a top plan view corresponding to FIG. 3 but with a portion of the cleanup assembly rotated 90 degrees similarly to FIG. 2.
Figure 5:
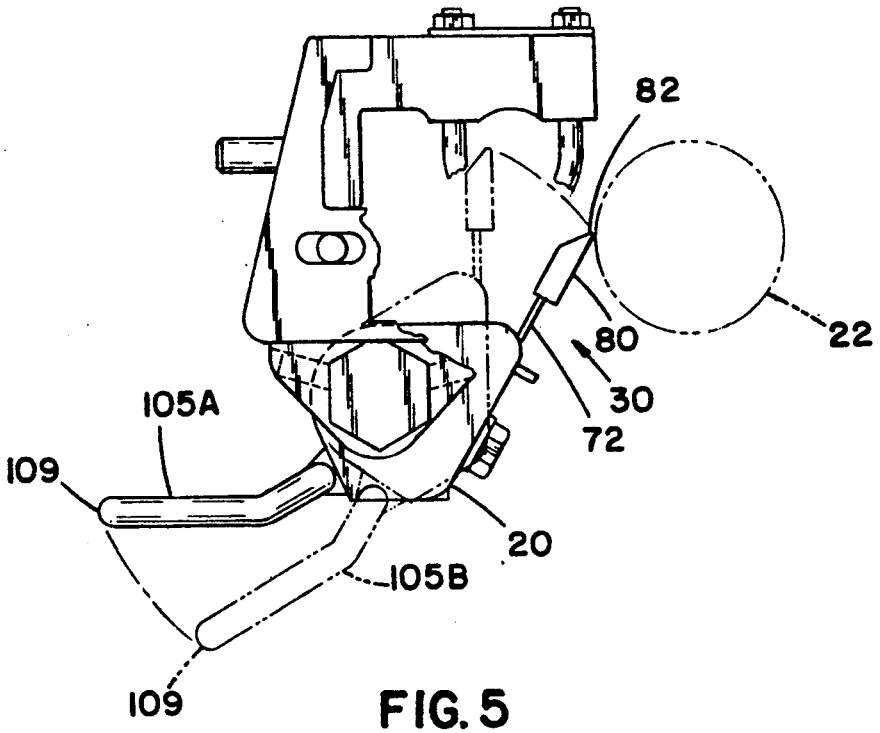
FIG. 5 is a fragmentary side elevational view of the cleaning assembly with a wiper blade assembly in contact with a printing press roller; phantom lines illustrating a wiper blade assembly in a non-contact orientation with respect to the printing press roller.

The cleaning assembly 10 comprises a fluid receptacle arrangement 20, as shown in FIGS. 2–7, which is constructed and arranged to operably receive fluid from a roller 22 in printing press 15, as shown in FIG. 5. The cleaning assembly 10 includes a mounting assembly 25, as shown in FIGS. 1–2. The cleaning assembly 10 also includes a wiper assembly 30, FIGS. 1–2, for selectively removing fluid from roller 22 in printing press 15, in operable association with the fluid receptacle arrangement 20, and selectively directing fluid from roller 22 to the fluid receptacle arrangement 20. The cleaning assembly 10 further includes a pivot arrangement 35 for selectively pivoting the flu.:d receptacle arrangement 20 between selected positions, i.e. about axis A—A as shown in FIG. 2.

Figure 3:
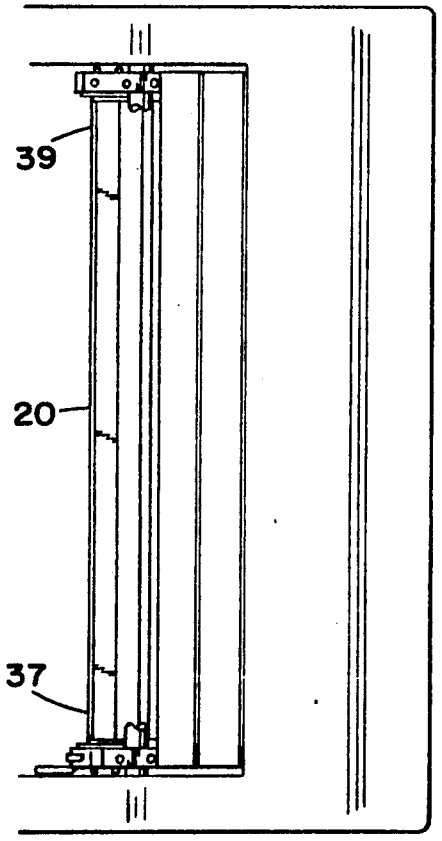
FIG. 3 is a fragmentary top plan view of the cleanup assembly of FIG. 1.

The fluid receptacle arrangement 20 can be pivoted about axis A—A along a path of motion between a first extreme position and a second extreme position. The first extreme position is defined when fluid receptacle arrangement 20 is operably positioned to selectively receive fluids, such as ink and cleaning solvents from printing press roller 22. The second extreme position is defined when fluid receptacle arrangement is pivoted about axis A—A such that fluid receptacle arrangement 20 is selectively positioned so that it does not receive fluids from printing press roller 22. Thus, the fluid receptacle arrangement 20 can be pivoted about axis A—A along a path of motion between a first extreme position, as shown in FIG. 1, and a second extreme position as shown in FIG. 2. Herein "between" in this context is not meant to require motion completely between the extremes in all instances of use. Motion part way between the extremes may also be of use. For the preferred embodiment shown, the first extreme position occurs when a first exterior end portion 37 and an opposite second exterior end portion 39 of the fluid receptacle arrangement 20 are substantially equidistant from the printing press 15 as depicted in FIG. 3. The second extreme position occurs when the fluid receptacle arrangement 20 is pivoted about pivot arrangement 35 such that the first exterior end portion 37 is further distant from the printing press 15 than the opposite second exterior end portion 39, as depicted in FIG. 4. That is, the preferred pivoting motion includes movement of first exterior end portion 37 further than second exterior end portion 39. The cleaning assembly 10 can be more readily cleaned when it is in the second extreme position. In addition, a person can easily gain access to the printing press rollers without having to remove fluid receptacle arrangement 20 when the cleaning assembly 10 is in the second extreme position.

Features concerning the pivot arrangement 35, and other advantageous characteristics of the cleaning assembly 10, will be understood from detailed descriptions of the various components of arrangement 10 as detailed hereinbelow.

Figure 6:
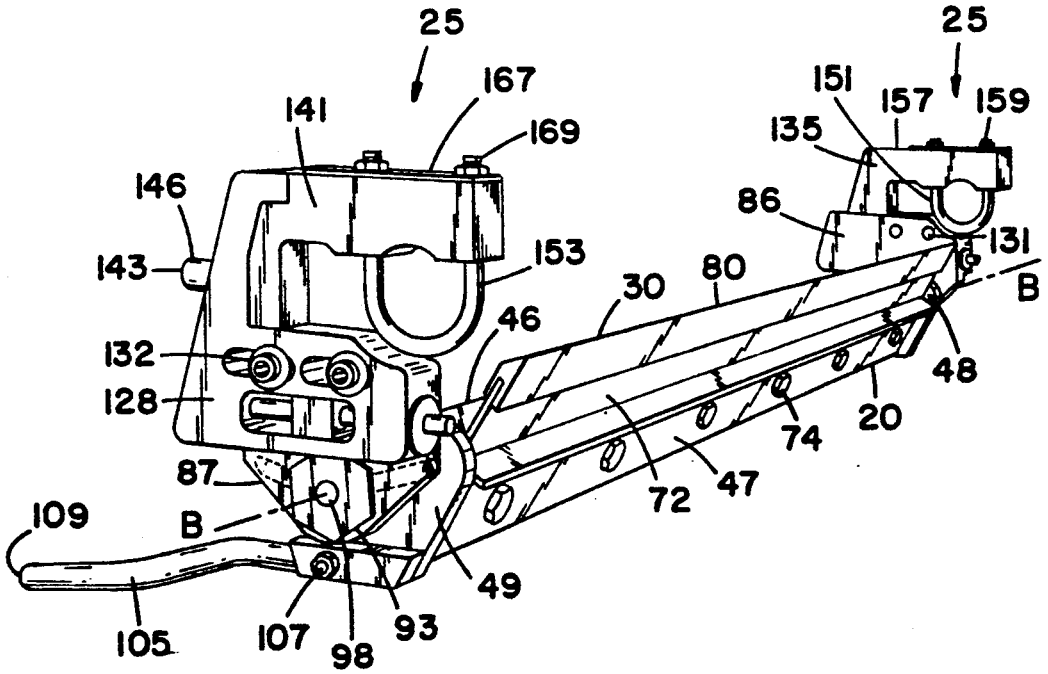
FIG. 6 is a perspective view of a cleaning assembly usable in a printing press according to the present invention.
Figure 7:
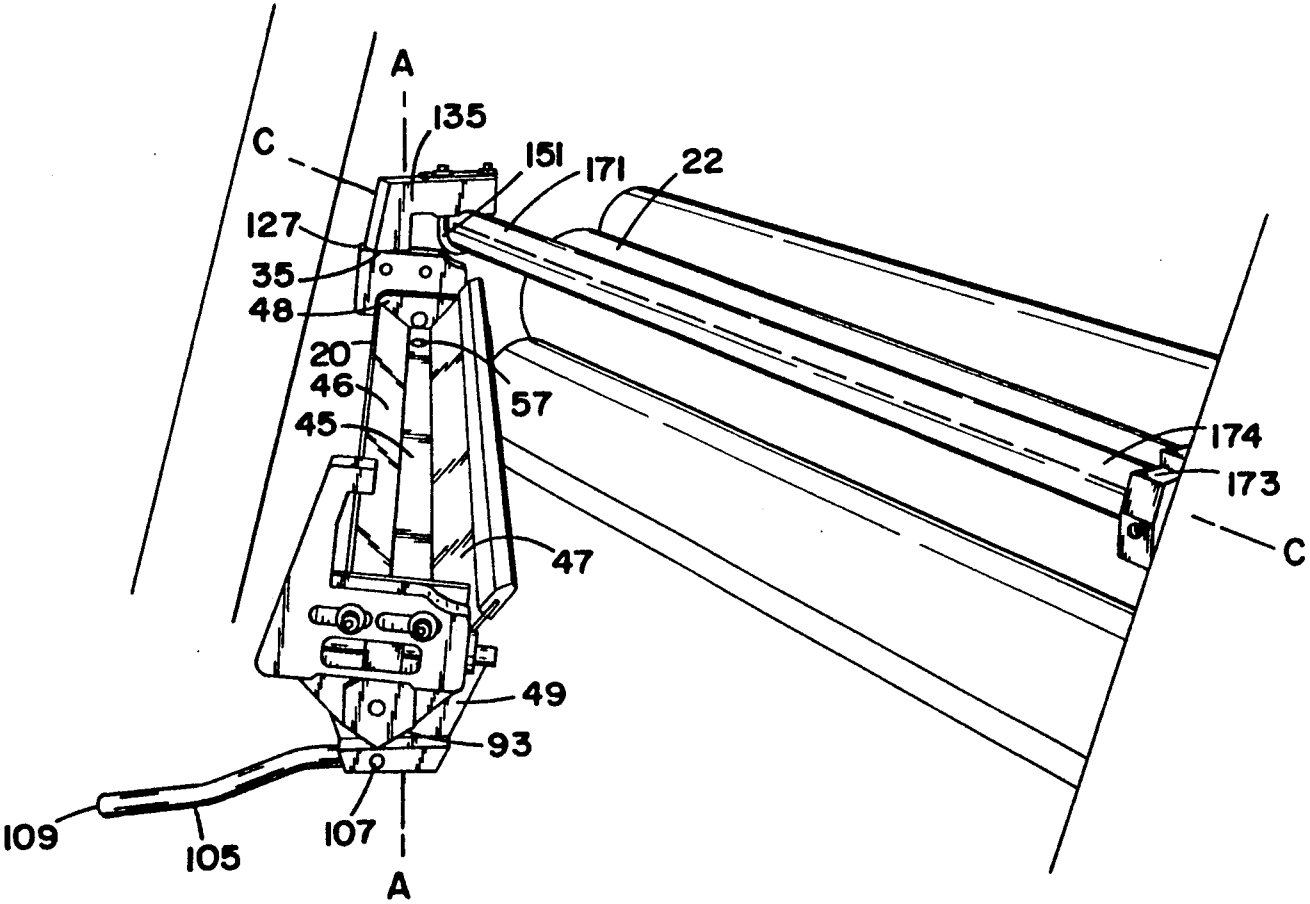
FIG. 7 is a perspective view of the cleaning assembly of FIG. 6 depicted mounted to a printing press roller and shown with a portion of the cleaning assembly rotated analogously to FIG. 2.

Attention is now directed to FIGS. 6 and 7 in which the fluid receptacle arrangement 20 is depicted along with the other components of cleaning assembly 10. Fluid receptacle arrangement 20 comprises a foundational base or bottom 45, FIG. 7, and four side walls 46, 47, 48 and 49 as shown collectively in FIGS. 6 and 7. Preferably, the foundational base 45 and side walls 46 and 47 are comprised of a single molded or fabricated solid material such as steel or a hard plastic. Side walls 48 and 49 are secured to foundational base 45 and side walls 47 and 48 to create a liquid-tight fluid receptacle arrangement 20 which is capable of receiving and holding fluid scraped or otherwise removed from printing tower 13, i.e. printing press roller 22. Preferably, side walls 46, 47, 48 and 49 are oriented in extension from foundational base 45 at an angle of at least about 90 degrees with respect to foundational base 45. Most preferably, side walls 46 and 47 extend from foundational base 45 at an angle of about 90° to about 145° with respect to foundational base 45 to create a trough-shaped fluid receptacle arrangement 20 as shown in FIGS. 6 and 7.

Cleaning assembly 10 may optionally include draining means 55 for removing fluid from the fluid receptacle arrangement 20, as shown in FIG. 2 without removal of the cleaning assembly 10 from the printing press 15. Draining means 55 is defined by an aperture 57, FIG. 7, which has been bored through foundational base 45 such that any fluid in fluid receptacle arrangement 20 will flow by gravity through aperture 57. Preferably, draining means 55 is further defined by nozzle arrangement 60 which is attached to the foundational base 45 as shown in FIG. 2. A suction tube 62, FIG. 2, is attached to the nozzle arrangement 60 such that suction tube 62 can operably remove fluid that has entered the nozzle arrangement 60. A vacuum apparatus 65, FIG. 2, is attached to the tube 62 such that the vacuum apparatus 65 will operably draw fluid through the tube 62. Vacuum apparatus 65 may include any of a variety of conventional mechanical devices well-known in the art which can operably draw fluid from fluid receptacle arrangement 20 through a tube or otherwise.

Attention is again directed to FIGS. 5 and 6 which depict, in part, wiper assembly 30. Wiper assembly 30 includes a wiper blade holder 72 which is attached to side wall 47 as shown in FIG. 6. Wiper blade holder 72 extends from foundational base 45 along side wall 47 and extends outward from the fluid receptacle arrangement 20. Wiper blade holder 72 may be attached to side wall 47 in any manner such that the wiper blade holder 72 remains securely fastened to side wall 47 when the wiper assembly 30 engages the printing press roller 22. For example, the wiper blade holder 72 may be welded, riveted or glued to side wall 47. In the preferred embodiment described and shown in FIG. 6, wiper blade holder 72 is attached to side wall 47 with a plurality of bolts 74. Means allowing for replacement of worn wiper blades may be provided.

Wiper blade holder 72 is preferably made from a strong, relatively inflexible material such as aluminum or steel. For the embodiment shown, wiper blade holder 72 is a relatively thin sheet of material configured so that it is capable of accommodating a wiper blade 80. The wiper blade 80 is preferably made from a flexible material such as rubber (typically a synthetic rubber) or a soft plastic. Wiper blade 80 can operably engage printing press roller 22 in operable association with the fluid receptacle arrangement 20 such that the end portion 82 of wiper blade 80 can remove fluid from roller 22 in printing press 15 and direct the fluid from roller 22 to the fluid receptacle arrangement 20 when roller 22 rotates, as shown in FIG. 5.

Figure 8:
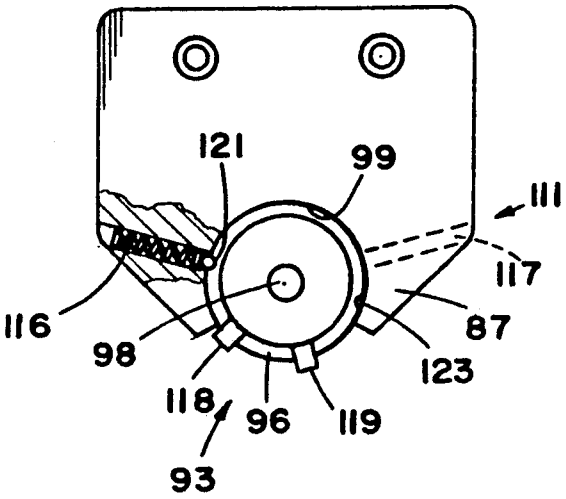
FIG. 8 is a side elevational view of an adjustment plate and locking arrangement when the cleaning assembly is locked in position A as illustrated in FIG. 5.

Fluid receptacle arrangement 20 is attached to first and second adjustment plates 86 and 87, respectively, as shown in FIG. 6. Side wall 49 is attached to second adjustment plate 87 by a first pivot plug assembly 93. Side wall 48 is attached to first adjustment plate 86 by a similar second pivot plug assembly (not shown). As shown in FIG. 8, pivot plug assembly 93 includes a first pivot plug 96 and a first pivot plug pin 98. First pivot plug 96 and second pivot plug each have a central cylindrical bore extending therethrough. A first exterior end point of first pivot plug pin 98 is secured to side wall 48. A second exterior end portion of first pivot plug pin 98 is operably oriented through the central bore of first pivot plug 96 which is operably positioned within a first pivot plug aperture 99 of first adjustment plate 86. The second exterior end portion of first stop pin is then secured to a first locking collar end plate (not shown) which operably secures first pivot plug 96 within the first pivot plug aperture 99 of second adjustment plate 87. The second pivot plug assembly is constructed in a substantially similar manner as first pivot plug assembly 93. When fluid receptacle arrangement 20 is rotated about axis B—B as shown in FIG. 6, first pivot plug 96 and second pivot plug will rotate about axis B—B within the pivot plug apertures of first and second adjustment plates 86 and 87, respectively.

A lever 105 is fastened to side wall 49 with a screw/-nut arrangement 107, as shown in FIGS. 6 and 7. As the end portion 109 (FIGS. 5 and 6) of lever 105 rotates about axis B—B, fluid receptacle arrangement 20 and wiper assembly 30 also rotate about axis B—B. Referring to FIG. 5, lever 105, designated as lever 105A in position A, can be moved into position B where the lever is noted as lever 105B. When lever 105 is in position A, wiper assembly 30 is in a first extreme orientation such that end portion 82 of wiper blade 80 is operably contacting printing press roller 22 during a cleaning phase. As lever 105 is moved into position B, the wiper assembly 30 moves away from printing press roller 22. A second extreme orientation is defined when wiper assembly 30 is selectively oriented such that the wiper blade 80 does not contact printing press roller 22 during a printing phase, as shown in phantom lines in FIG. 5.

Figure 9:
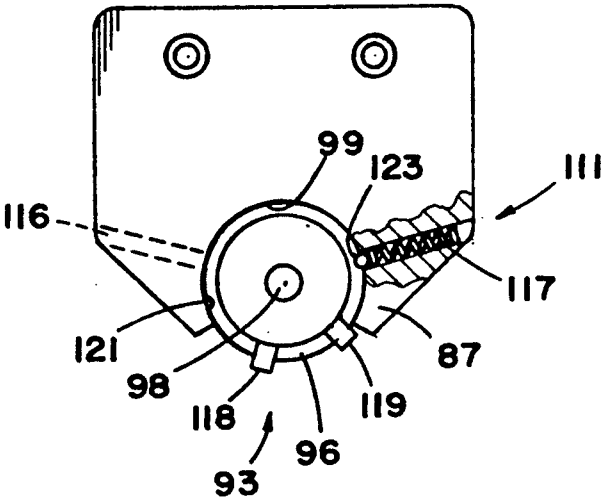
FIG. 9 is a side elevational view of an adjustment plate and locking arrangement when the cleaning assembly is locked in position B as illustrated in FIG. 5.

For the preferred embodiment described and shown, the first pivot plug assembly 93 and second pivot plug assembly have locking means 111 for securing fluid receptacle arrangement 20 in the first extreme orientation. Only the locking means 111 associated with first pivot plug assembly 93 is described below. It will be understood that second pivot plug assembly preferably also includes a substantially similar locking means 111. In a preferred embodiment, the first extreme orientation is designated as position A in FIGS. 5. Locking means 111 also secures fluid receptacle arrangement 20 when it is rotated about axis B—B into the second extreme orientation as shown in FIG. 9. In a preferred embodiment, second extreme orientation is designated by phantom lines as position B in FIG. 5.

For the preferred embodiment described and shown, each locking means 111 comprises first and second ball plungers 116 and 117, as shown in FIGS. 8 and 9, which are associated with first pivot plug assembly 93 and third and fourth ball plungers which are associated with second pivot plug assembly. Locking means 111 further includes a first and second stop pin, 118 and 119, as shown in FIGS. 8 and 9, associated with first pivot plug assembly 93 and a third and fourth stop pin associated with the second pivot plug assemblies. Referring to FIG. 8, fluid receptacle arrangement 20 rotates about axis B—B until first stop pin 118 contacts second adjustment plate 87 and first ball plunger 116 engages first indentation 121, respectively, as shown in FIG. 8, to secure fluid receptacle arrangement 20 in the first extreme orientation. Referring to FIG. 9, fluid receptacle arrangement 20 can be rotated about axis B—B until second stop pin 119 contacts second adjustment plate 87 and second ball plunger 117 engages second indentation 123, respectively as shown in FIG. 8, to secure fluid receptacle arrangement 20 in the second extreme orientation.

First and second adjustment plates 86 and 87 are attached to a first and second frame plate 127 and 128, respectively, in FIG. 6. First and second adjustment plates 86 and 87 are attached to first and second frame plates 127 and 128, respectively, with a first and second dual screw/nut arrangement 131 and 132, respectively.

First frame plate 127, as shown in FIG. 7, is attached to a first mounting frame 135 by means of pivot arrangement 35 as shown in FIGS. 2 and 7. Pivot arrangement 35 has a an axis A—A extending therethrough, as designated in FIGS. 2 and 7, and is positioned with the axis A—A being generally orthogonal to (but not necessarily intersecting) an axis C—C extending through the printing press roller, as shown in FIG. 7. In the preferred embodiment shown in FIG. 7, pivot arrangement 35 includes any variety of conventional pivoting mechanisms which permit the first mounting frame 135 to be in direct contact with first frame plate 127 while allowing fluid receptacle arrangement 20 to pivot about axis A—A. Pivot arrangement 35 may be positioned such that axis A—A tangentially intersects side wall 48; however, pivot arrangement 35 should not be positioned such that axis A—A intersects sidewalls 46, 47, 48 or foundational base 45. Preferably, pivot arrangement 35 is positioned such that axis A—A does not intersect any portion of fluid receptacle arrangement 20.

For the arrangement shown, the fluid receptacle arrangement 20 may be rotated from approximately 0° about axis A—A with respect to printing press roller 22 to approximately 135° about the axis A—A with respect to printing press roller 22. A first extreme position is defined when fluid receptacle arrangement 20 is operably positioned to selectively receive ink and cleaning solvents from printing press roller 22. A second extreme position is defined when fluid receptacle arrangement 20 is pivoted about axis A—A such that fluid receptacle arrangement 20 is operably positioned so that it does not receive ink and solvents from a printing press roller 22. In a preferred embodiment, the first extreme position is defined as shown in FIG. 1 when the fluid receptacle arrangement 20 is rotated approximately 0° about axis A—A with respect to printing press roller 22. In the preferred embodiment, the second extreme position is defined when the fluid receptacle arrangement is rotated at least approximately 45° about axis A—A with respect to the first extreme position as shown in FIGS. 2, 4 and 7. More preferably, the second extreme position is defined when the fluid receptacle arrangement is rotated between approximately 45° to 135° about axis A—A with respect to the first extreme position. Most preferably, the second extreme position is defined when the fluid receptacle arrangement is rotated approximately 90° about the axis A—A with respect to the first extreme position, as shown in FIGS. 2 and 4. The second extreme position allows the fluid receptacle arrangement to be readily cleaned after cleaning assembly 10 has been utilized to remove solvents and ink from rollers of printing press 15.

Attention is now directed to second frame plate 128 in FIG. 6. Second frame plate 128 is operably attached to second mounting frame 141 by a frame plate/mounting frame fastening arrangement 143. Fastening arrangement 143 includes any conventional bolting mechanism which fastens second mounting frame 141 to second frame plate 128. Preferably, fastening arrangement 143 comprises a thumb screw pivot lock 146 which can be removed from second mounting frame 141 and second frame plate 128 such that second frame plate 128 can become detached from second mounting frame 141, allowing fluid receptacle arrangement 20 to rotate about axis A—A as shown in FIG. 7.

Attention is now directed to the first and second mounting frames 135 and 141, as shown in FIG. 6. Mounting frames 135 and 141 are both a part of mounting arrangement 25 which further includes a first U-bolt 151, which is operably attached to first mounting frame 135, and a second U-bolt 153 which is operably attached to second mounting frame 141. First U-bolt 151 is secured by a first lock plate 157 and a first pair of U-bolt nuts 159. Second U-bolt 153 is secured by a second lock plate 167 and a second pair of U-bolt nuts 169.

U-bolts 151 and 153, lock plates 157 and 167, and U-bolt nuts 159 and 169 selectively mount fluid receptacle arrangement 20 in an operable relation to a roller 22, in printing press 15 such that the fluid receptacle arrangement 20 is capable of receiving fluid therefrom. As shown in FIG. 7, U-bolts 151 and 153 fit around end portions 171 and 173 of mounting bracket 174, respectively, without affecting the operation of the printing press roller itself.

With the present invention as defined above, the cleaning assembly 10 can be used in the following manner. After printing press 15 has completed a printing operation, a solvent system 175, as designated in FIGS. 1 and 2, will deliver solvents to the printing press rollers. Referring to FIG. 5, lever 105 can be moved from position B to position A which causes the fluid receptacle arrangement 20 to rotate such that wiper assembly 30 comes in contact with the printing press roller. As the roller turns, ink and solvent from the printing press roller will be removed by end portion 82 of wiper blade 80. The ink will then flow by gravity from wiper assembly 30 to fluid receptacle arrangement 20.

A vacuum arrangement 65, as shown in FIG. 2, can be activated such that fluid in the fluid receptacle arrangement 20 will flow through aperture 57 and into tube 62 thus draining most of the fluid from fluid receptacle arrangement 20. After a majority of the ink and solvent fluids have been drained from fluid receptacle arrangement 20, vacuum arrangement 65 can be deactivated. The thumb screw pivot lock 146 can then be removed such that fluid receptacle arrangement 20 can be rotated about axis A—A by means of pivot arrangement 35, as shown in FIGS. 2 and 7. Fluid receptacle arrangement 20 can then be rotated from about 45° to about 135° about axis A—A, such that fluid receptacle arrangement 20 can be thoroughly washed out. It is advantageous to rotate fluid receptacle arrangement 20 from the potentially hazardous printing press rollers so that a person can readily clean the fluid receptacle arrangement 20 without having to remove it completely from the printing press 15.

The present invention includes within its scope provision as a solvent delivery system on a printing tower, in association with the cleaning arrangement described, to facilitate cleaning. In the foregoing detailed description of a preferred embodiment has been described. Modifications and equivalents of the disclosed concepts, such as those which may readily occur to one skilled in the art, are intended to be included within the scope of the present invention. Accordingly, the scope of the present invention is to be limited only by the scope of the claims.

I claim:

1. A cleaning assembly for removal of fluid from a roller in a printing press; said arrangement comprising:

(a) a fluid receptacle arrangement constructed and arranged to operably receive fluid from a roller in a printing press, said fluid receptacle arrangement having first and second end portions with a first longitudinal axis extending therebetween;

(b) means for mounting said fluid receptacle arrangement in operable relation to a roller in a printing press, to receive fluid therefrom;

(c) means for selectively removing fluid from a roller in a printing press, in operable association with said fluid receptacle arrangement, to direct fluid from the roller to said fluid receptacle arrangement;

(d) means for selectively pivoting said fluid receptacle arrangement between first and second extreme positions;

(i) said first extreme position occurring when a said fluid receptacle arrangement is operably positioned to selectively receive fluid from the roller in the printing press; and (ii) said second extreme position occurring when said fluid receptacle arrangement is rotated about said first longitudinal axis such that it cannot selectively receive fluid from the roller on the printing press; and (e) means for selectively pivoting said fluid receptacle arrangement between third and fourth extreme positions; wherein said means for selectively pivoting said fluid receptacle arrangement between said third and fourth extreme positions comprises a pivot arrangement operably positioned adjacent to said first end portion of said fluid receptacle arrangement; said pivot arrangement defining a second axis extending therethrough generally orthogonal to said first axis and extending through said fluid receptacle first end portion;

(i) said pivot arrangement being constructed and arranged for selective pivoting of said fluid receptacle second end portion about said second axis.

2. A cleaning assembly for removal of fluid from a roller in a printing press according to claim 1 wherein said fluid receptacle arrangement comprises:

(a) a base wall; and (b) four exterior walls attached to said base wall such that said fluid receptacle arrangement is trough-shaped.

3. A cleaning assembly for removal of fluid from a roller in a printing press according to claim 1 wherein said means for mounting said fluid receptacle arrangement in operable relation to a roller in a printing press comprises a mounting assembly; said mounting assembly includes a first and second frame plate, first and second U-bolts for operably engaging end portions of a mounting bracket in operable relation to a printing press roller, said first U-bolt operably attached to said first frame plate of the fluid receptacle arrangement and said second U-bolt operably attached to said second frame plate of the fluid receptacle arrangement.

4. A cleaning assembly for removal of fluid from a roller in a printing press according to claim 1 wherein said means for selectively removing fluid from a roller in a printing press roller comprises a wiper assembly.

5. A cleaning assembly for removal of fluid from a roller in a printing press according to claim 4 wherein said wiper assembly comprises a flexible wiper blade.

6. A cleaning assembly for removal of fluid from a roller in a printing press according to claim 1 wherein said fourth extreme position is further defined as resulting from rotation of said receptacle arrangement between approximately 45° to 135° about the second axis, with respect to the third extreme position.

7. A cleaning assembly for removal of fluid from a roller in a printing press according to claim 1, wherein said cleaning assembly further comprises means for draining fluid from said fluid receptacle arrangement without removal of said cleaning assembly from the printing press.

8. A cleaning assembly for removal of fluid from a roller in a printing press according to claim 7, wherein said means for draining fluid comprises a base wall of said fluid receptacle arrangement, said base wall having an aperture for draining fluid from said fluid receptacle arrangement.

9. A cleaning assembly for removal of fluid from a roller in a printing press according to claim 8, wherein said means for draining fluid further comprises a vacuum apparatus attached to said fluid receptacle arrangement, said vacuum apparatus operably drawing fluid from said fluid receptacle arrangement during a cleaning operation.

10. A cleaning assembly for removal of fluid from a roller in a printing press according to claim 1, wherein said cleaning arrangement further comprises a wiper blade and means for locking a wiper blade in:

(a) a first extreme orientation wherein said wiper blade is operably contacting the roller during a cleaning phase; or (b) a second extreme orientation wherein said wiper blade is selectively oriented such that said wiper blade does not contact the roller during a printing phase.

* * * * *